US010048003B2

(12) United States Patent
Jibb et al.

(10) Patent No.: US 10,048,003 B2
(45) Date of Patent: Aug. 14, 2018

(54) INSULATION ARRANGEMENT

(71) Applicants: Richard John Jibb, Wheatfield, NY (US); John Henri Royal, Grand Island, NY (US)

(72) Inventors: Richard John Jibb, Wheatfield, NY (US); John Henri Royal, Grand Island, NY (US)

(73) Assignee: PRAXAIR TECHNOLOGY, INC., Danbury, CT (US)

( * ) Notice: Subject to any disclaimer, the term of this patent is extended or adjusted under 35 U.S.C. 154(b) by 527 days.

(21) Appl. No.: 14/734,244

(22) Filed: Jun. 9, 2015

(65) Prior Publication Data

US 2015/0267962 A1 Sep. 24, 2015

Related U.S. Application Data

(62) Division of application No. 11/605,697, filed on Nov. 30, 2006, now Pat. No. 9,086,235.

(51) Int. Cl.
*F25J 3/04* (2006.01)

(52) U.S. Cl.
CPC ..... *F25J 3/04945* (2013.01); *F25J 2290/30* (2013.01)

(58) Field of Classification Search
CPC .... F25J 3/0489; F25J 3/04945; F25J 2290/30; F25J 1/0261
See application file for complete search history.

(56) References Cited

U.S. PATENT DOCUMENTS 6,378,331 B1 * 4/2002 Vancauwenberghe ..... F25J 3/04872 62/643

FOREIGN PATENT DOCUMENTS

FR 2803652 A1 * 7/2001 ..... F24H 1/182
GB 2358909 A * 8/2001 ..... F25J 3/04412
JP 2005106127 A * 4/2005

OTHER PUBLICATIONS

English translation of JP 2005106127 provided by Espacenet. Sep. 2017.*
English translation of FR 2803652 A1, provided by Espacenet. May 2018.*

* cited by examiner

*Primary Examiner* — Tareq Alosh
(74) *Attorney, Agent, or Firm* — Robert J. Hampsch

(57) ABSTRACT

An arrangement of insulation within a container to prevent heat leakage from the ambient to an apparatus located within the container that operates at a cryogenic temperature. The arrangement of insulation includes bulk insulation filling the container and an insulation layer that is located within the container, between the apparatus and the container. The insulation layer as opposed to the bulk insulation has a lower thermal conductivity. An exterior region of the apparatus is situated closer to an opposite container wall region of the container than remaining exterior regions of the apparatus. The insulation layer is sized to only insulate the exterior region of the apparatus from heat leakage from the opposite container wall region. The insulation layer can be formed of an aerogel.

3 Claims, 2 Drawing Sheets

INSULATION ARRANGEMENT

RELATED APPLICATION

This application is a divisional application of prior U.S. patent application Ser. No. 11/605,697, filed Nov. 30, 2006, now allowed, the entire contents of which is incorporated herein by reference in its entirety.

FIELD OF THE INVENTION

The present invention relates to an arrangement of insulation to insulate an apparatus operating at cryogenic temperature within a container from heat leakage through the container walls. More particularly, the present invention relates to such an arrangement in which bulk insulation fills the container and an insulation layer having a lower thermal conductivity than the bulk insulation is located between the apparatus and the container wall.

BACKGROUND OF THE INVENTION

In many industrial applications, an apparatus that is designed to operate at cryogenic temperatures is located within an insulated container to prevent heat leakage from the ambient to the apparatus.

An example of apparatus that has operational temperature requirement is a cryogenic distillation apparatus in which air is compressed, purified and then cooled to a temperature at or near its dew point for distillation in one or more distillation columns to separate lighter components such as nitrogen and argon from heavier components such as oxygen. The incoming air is cooled against product streams such as nitrogen and oxygen within a main heat exchanger.

Another example is a device for liquefying natural gas whereby gas from a high pressure pipeline is expanded, cooled and condensed to produce a liquefied natural gas (LNG) product.

In order to maintain the low temperatures required for a cryogenic distillation apparatus, a distillation column or columns and the heat exchanger can be placed within a container known as a cold box. Such a container operates at a positive pressure, that is, the container is not sealed to the ambient. Bulk fill insulation, ordinarily in particulate form is introduced into the container to provide insulation. Such bulk fill insulation, for example PERLITE, inhibits convective heat transfer and constrains the heat transfer to take place through conduction. Since conductive heat transfer predominates, radiant heat transfer effects are minimal.

Another type of insulation that has been proposed for use in connection with cryogenic equipment is aerogel insulation. Aerogels have the advantage of having a lower thermal conductivity than traditional insulation materials such as Perlite. Aerogels are water-free gels that are dried such that the solid matter of the gel remains intact to produce an open cell structure which can include inorganic aerogels that are formed of silica, alumina, zirconia, tungsten and titanium. Additionally, organic aerogels such as resorcinol-formaldehyde aerogels have also been formed. Aerogels can be formed as a solid block of material, as a fine powder, or as pellets. Aerogel materials can also be used as fill for a blanket or mixed and strengthened with fibers to form a blanket-like or mat-like structure.

A minimum insulation thickness is required to prevent excessive heat leakage, which will result in local ice spots from forming on the surface of the container. The container is not suitable for exposure to cryogenic temperatures. A minimum thickness is also required to prevent embrittlement of the container walls and structural supports. As can be appreciated, the lower the thermal conductivity of the insulation, the smaller the minimum thickness of insulation, and the smaller the container because less insulation would be required. The problem with replacing a bulk fill insulation material, such as PERLITE, with an aerogel is that although an aerogel has a thermal conductivity that is approximately 4 times less than PERLITE, it is also much more expensive. Therefore, although the containment, for example a cold box, can be made smaller than by the use of PERLITE alone, it has been found by the inventors herein that the added expense of the aerogel insulation does not justify its use in such applications.

As will be discussed, the present invention provides an arrangement of insulation in which the use of low thermal conductivity insulation, such as aerogel is minimized to allow the container to be made smaller than would otherwise be possible with the use of higher thermal conductivity insulation such as PERLITE.

SUMMARY OF THE INVENTION

The present invention provides an arrangement of insulation within a container having an internal positive pressure to prevent heat leakage from the ambient to an apparatus located with the container and designed to operate at a cryogenic temperature. As used herein and in the claims, the term "positive pressure" means pressure that is at or near ambient pressure and not a vacuum or a subatmospheric pressure approaching a vacuum.

In accordance with the invention a bulk insulation fills the container. As used herein and in the claims, the term "bulk insulation" means an insulation, typically in powder or pellet form that can be used to fill the container and completely surround the apparatus.

Additionally, an insulation layer is located within the container between the apparatus and the container. It is to be noted that the term, "layer" as used herein and in the claims means any element having an overall length, width and depth or thickness. A layer of the present invention need not be rigid in that it can be formed of a blanket and further, can conform to an element of an apparatus to be covered thereby. A rigid layer is not, however excluded from the definition of the term "layer". Furthermore, the term "between" does not mean that such insulation layer is necessarily spaced from the apparatus or the container wall. For example, the insulation layer could be situated on the apparatus and conform thereto or could be in physical contact with the container wall and still be situated between the apparatus and the container wall.

The insulation layer of the present invention has a thermal conductivity lower than the bulk insulation. An exterior region of the apparatus is situated closer to an opposite container wall region of the container than remaining exterior regions of the apparatus. As such, the insulation layer is sized only to insulate the exterior region of the apparatus from heat leakage from the opposite container wall region to the apparatus.

The insulation layer can be aerogel. Moreover, as indicated above, the aerogel can be in a blanket form, namely as a fibrous-mat material or as fill in a blanket material. As also mentioned above, the insulation layer can be located on the apparatus.

Both the container and apparatus can be of cylindrical configuration. In such case, when the apparatus is not centered within the container, the exterior region of the apparatus will be an outer segment of an outer cylindrical surface of the apparatus and the opposite wall region will be an inner segment of an inner cylindrical surface of the container. The insulation layer covers the outer segment of the outer cylindrical surface of the apparatus.

The container can also be of rectangular transverse cross-section as defined by four connected side walls. The apparatus can be of cylindrical configuration and the insulation layer is therefore one of four adjacent insulation layers covering four adjacent equal segments of the outer cylindrical surface of the apparatus. The opposite wall region in such case can be one of four opposite wall regions of the four connected side walls located opposite to the adjacent equal segments of the outer cylindrical surface of the apparatus.

The container can be of rectangular cross-section, have four connected side walls and can constitute a cold box. In such case, the apparatus can include an distillation column and a heat exchanger. The distillation column is of cylindrical configuration and the heat exchanger has a rectangular transverse cross-section and operates at a warmer temperature than that of the distillation column. The insulation layer in such embodiment of the invention is one of five insulation layers. A first and second of the five insulation layers cover two adjacent segments of the outer cylindrical surface of the distillation column located closest to a first side wall and a second side wall of the four connected side walls. A third and fourth of the five insulation layers covers two opposite first and second sides of the heat exchanger located closest to the second side wall and a third side wall of the four connected side walls. A fifth of the five insulation layers covers a fourth of the four connected side walls located opposite to a third side of the heat exchanger connecting the two opposite first and second sides of the heat exchanger. Additionally, the arrangement can further comprise a six insulation layer located on a fourth side of the heat exchanger located opposite to the distillation column to insulate the distillation column from additional heat leakage from the heat exchanger to the distillation column.

In the embodiment discussed directly above, the insulation layer can be an aerogel insulation of blanket form. Further, each of the four adjacent insulation layers can also be an aerogel insulation of blanket form. Also, the five insulation layers and the sixth insulation layer can each be an aerogel insulation of blanket form.

As can be appreciated from the above discussion, the expensive insulation is used sparingly, namely to insulate surfaces of the container closest to the container walls. In such manner, the container for the cryogenic apparatus can be made more compact than otherwise would have been possible had a solely bulk fill insulation been used having a much higher thermal conductivity than the lower thermal conductivity insulation, for example, an aerogel. In this regard, as used herein and in the claims, the term "aerogel" means any material that is formed from water-free gels that are dried such that the solid matter of the gel remains intact to produce an open cell structure solid material possessing no less than 50% porosity by volume.

BRIEF DESCRIPTION OF THE DRAWINGS

While the specification concludes with claims distinctly pointing out the subject matter that Applicants regard as their invention, it is believed that the invention will be better understood when taken in connection with the accompanying drawings in which:

DETAILED DESCRIPTION

Figure 1:
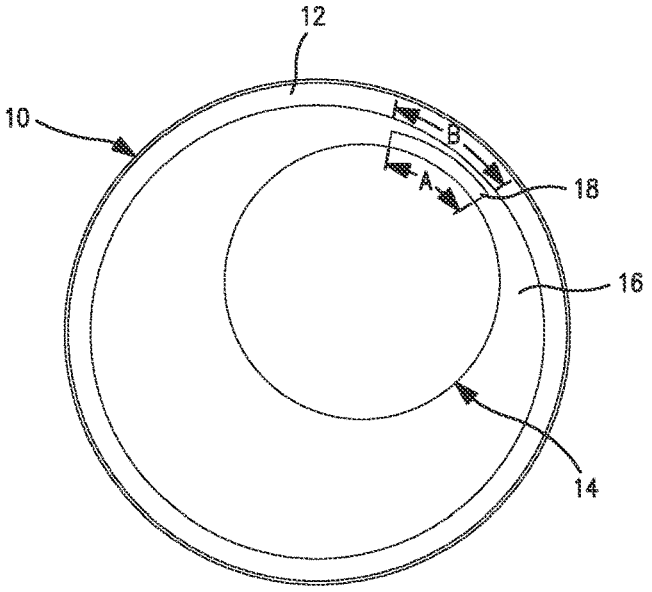
FIG. 1 is a schematic, sectional view of an insulation arrangement in accordance with the present invention.

With reference to FIG. 1, an arrangement of insulation is illustrated within a container 10 that is not air tight and therefore has an internal positive pressure that is at an atmospheric pressure.

Container 10 is of cylindrical configuration and as such has a cylindrical side wall 12. Located within container 10 is an apparatus 14 that is designed to operate at a cryogenic temperature. For instance, apparatus 14 could be a distillation column of an air separation unit in which air is rectified to cryogenic temperatures. It is to be noted that in such apparatus, air is cooled to at or near its dew point and then introduced into a distillation column in which an ascending vapor phase containing the lighter components of the air, for example, nitrogen, is in part liquefied at the top of the column to reflux the column with liquid. The descending liquid phase contacts the ascending vapor phase through a contact element such as structured packing or sieve trays to produce mass transfer between the phases. As a result, the ascending vapor phase becomes evermore rich in the lighter components such as nitrogen than the descending liquid phase becomes evermore rich as it descends with oxygen.

In order to reduce heat leakage from the ambient through the container wall 12 to apparatus 14, an arrangement of insulation is provided in accordance with the present invention. The arrangement of insulation consists of bulk insulation 16, for instance, PERLITE, microcel, rockwool which is simply poured into container 10. In addition to that, an insulation layer 18 is located within the container between the apparatus 14 and the container wall 12. The insulation layer 18 has a lower thermal conductivity than that of the bulk insulation 16. For example, the insulation layer 18 can be formed of aerogel. Fiberglass, polyurethane or polyisocyanurate layers are also possible.

It is apparent from FIG. 1, apparatus 14 is off center. As such, an exterior region of the apparatus 14, situated between arrowheads "A", is located closer to an opposite container wall region of container wall 12, located between arrowheads "B", than remaining exterior regions of apparatus 14. The insulation layer 18 is sized to only insulate the exterior region between arrowhead "A" of the apparatus 14 from heat leakage from the opposite container wall region between arrowheads "B". As such, the advantages of minimizing the use of expensive insulation such as aerogel are realized. In addition, if one views the remaining wall regions, they are located further from the exterior surface of apparatus 14. As such, there exists a sufficient depth of bulk insulation 16 to provide the insulation. Hence, the width of insulation layer 18 is sized so that adjacent regions will have a sufficient depth of the bulk fill insulation 16 to in turn sufficiently insulate apparatus 14 from heat leakage from remaining container wall regions of container wall 12. The calculation of the necessary width of insulation layer 18 and its thickness is a manner of conventional calculation that is known by those skilled in the art.

Thus, apparatus 14 can be located closer to container wall 12 than otherwise would have been possible without the insulation layer 18. As a result, container 10 can be made smaller than would otherwise have been possible with the use of the bulk insulation 16 alone.

Preferably, the insulation layer 18 is in a blanket form and thus constitutes a layer which is attached to the exterior surface of apparatus 14. Although less preferred, the insulation layer 18 could be located on the opposite container wall region "B". Within the scope of the present invention, it would even be possible to locate an insulation layer 18 between the exterior region designated by arrowheads "A" and the interior region situated between arrowheads "B".

Although insulation layer 18 has been discussed above with respect to an aerogel blanket, other forms of aerogel are possible such as a pellet form retained between rigid or semi-rigid walls, a physical intact solid form, a fibrous mat containing the aerogel in which the fibrous mat reinforces the aerogel. Additionally, insulation layer could be made from a sheet of fiberglass or any other material having a lower thermal conductivity than the bulk fill insulation 16.

Figure 2:
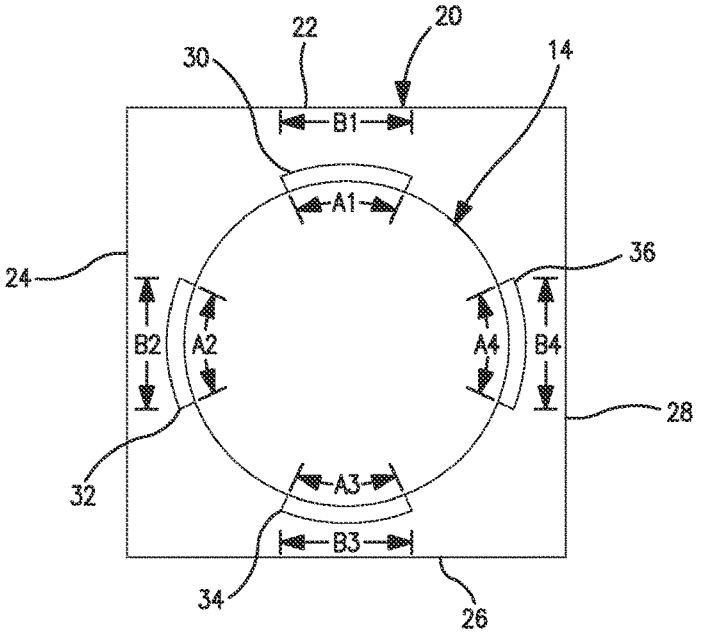
FIG. 2 is an alternative embodiment of an arrangement of insulation in accordance with the present invention.

With reference to FIG. 2, apparatus 14 is located within a container 20 that is of rectangular transverse cross-section and that has four connected side walls 22, 24, 26 and 28. In this embodiment of the present invention, apparatus 14 is centered within container 20. However, as a result of the intersection between the cylindrical configuration of apparatus 14 and the rectangular configuration of container 20, there will be four opposed exterior regions located between the respective arrowheads "$A^1$", "$A^2$", "$A^3$" and "$A^4$" of apparatus 14 that is situated closer to interior wall regions of container walls 22, 23, 26 and 28 designated by the regions located between arrowheads "$B^1$", "$B^2$", "$B^3$" and "$B^4$" respectively. Thus, in accordance with the present invention, insulation layers 30, 32, 34 and 36 will cover four adjacent equal segments of the exterior surface of apparatus 14, namely, the exterior regions located between arrowheads "$A^1$", "$A^2$", "$A^3$" and "$A^4$".

Figure 3:
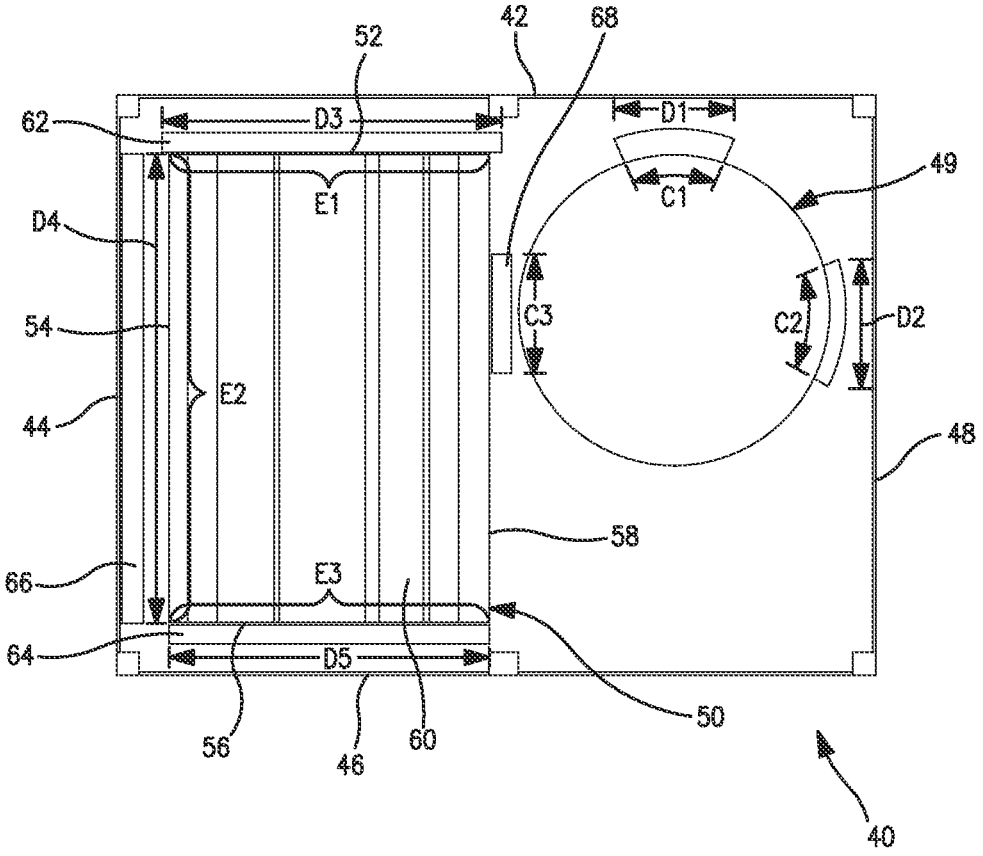
FIG. 3 is an alternative embodiment of an arrangement of insulation in accordance with the present invention.

With reference to FIG. 3, a container 40 is illustrated that is of rectangular transverse cross-section and that has four connected side walls 42, 44, 46 and 48. Container 40 constitutes a cold box in which the apparatus is a distillation column 49 of an air separation unit. Additionally, the apparatus also includes a heat exchanger 50. Heat exchanger 50, is typically of plate-fin design and as such, constitutes a structure that geometrically has four rectangular side walls 52, 54, 56 and 58 that are connected at the top and bottom by rectangular top and bottom walls of which top wall 60 can be seen in the illustration.

Heat exchanger 50 is used to cool the air being distilled within the cryogenic rectification column 14. However, it also operates at a higher temperature being that it is cooling the incoming air. Thus, in the cold box or container 40, there exists heat leakage from the ambient through the container walls 42, 44, 46 and 48 and also potentially heat leakage from heat exchanger 50 to distillation column 14.

Distillation column 49 is off center. As such, there exists two adjacent segments of the outer surface of the distillation column 49, located between arrowheads "$C^1$" and "$C^2$", that are closer to opposed wall regions of container walls 42 and 48, located between arrowheads "$D^1$" and "$D^2$".

With respect to heat exchanger 50 there exists three exterior regions of heat exchanger sides 52, 54 and 56, located within brackets "$E^1$", "$E^2$" and "$E^3$", that exists closer to opposite wall regions of container walls 42, 44 and 46 that are designated by arrowheads "$D^3$", "$D^4$" and "$D^5$". Insulation layers 62 and 64 are provided that cover sides 52 and 56, respectively, of heat exchanger 50. An insulation layer 66 is provided that is attached to side wall 44 to increase the insulation between heat exchanger side 54 and side wall 44.

In order to allow distillation column 49 to be positioned in a close proximity to heat exchanger 50, an insulation layer 68 is provided on side 58 of heat exchanger 50 that is located opposite to an exterior surface of distillation column 49, situated between arrowheads "$C^3$".

While the present invention has been described with reference to a preferred embodiment as will occur to those skilled in the art, numerous changes, additions and omissions may be made without departing from the spirit and scope of the present invention.

We claim:

1. An arrangement of insulation within a container having an internal positive pressure to prevent heat leakage from the ambient to an apparatus located within the container and operable at cryogenic temperature, wherein:

the container is a cold box of an air separation plant, and has a rectangular transverse cross-section and four connected sidewalls;

the apparatus has first exterior regions located opposite to the sidewalls of the container and situated closer to the sidewalls than remaining exterior regions of the apparatus; and, the apparatus includes a distillation column and a heat exchanger, the distillation column having a cylindrical transverse cross-section, and the heat exchanger having a rectangular transverse cross-section and operable at a warmer temperature than that of the distillation column;

the arrangement of insulation comprising:

first, second, third, fourth, fifth and sixth insulation layers; and, bulk insulation disposed within said container and filling portions of the container that are not filled by the apparatus and the insulation layers including portions of the container between the insulation layers and the sidewalls of the container;

wherein the first, second, third and fourth insulation layers are disposed apart from the sidewalls of container and attached to the first exterior regions of the apparatus only between the first exterior regions of the apparatus and the closer situated sidewalls of the container, such that:

the first and second insulation layers cover two adjacent segments of the outer cylindrical surface of the distillation column located closest to a first sidewall and a second sidewall of the four connected sidewalls of the container; and, the third and fourth insulation layers cover two opposite first and second sides of the heat exchanger located closest to the second sidewall and a third sidewall of the four connected sidewalls of the container;

and wherein:

the fifth insulation layer covers a fourth of the four connected sidewalls of the container, the fourth sidewall located opposite to a third side of the heat exchanger which connects the opposite first and second sides of the heat exchanger;

the sixth insulation layer is located on a fourth side of the heat exchanger located opposite to said distillation column to insulate the distillation column from heat leakage from the heat exchanger to the distillation column; and, the insulation layers have a thermal conductivity lower than that of the bulk insulation.

2. The arrangement of insulation of claim 1, wherein each of the insulation layers is an aerogel blanket insulation.

3. The arrangement of insulation of claim 1, wherein each of the insulation layers is a fibrous mat containing aerogel in which the fibrous mat reinforces the aerogel.

* * * * *